US009666354B2

(12) United States Patent
Zuo et al.

(10) Patent No.: US 9,666,354 B2
(45) Date of Patent: May 30, 2017

(54) TRANSFORMER

(71) Applicant: DELTA ELECTRONICS, INC., Taoyuan Hsien (TW)

(72) Inventors: Zhuang Zuo, Taoyuan Hsien (TW); Jian Zhou, Taoyuan Hsien (TW); De-Zhi Jiao, Taoyuan Hsien (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 227 days.

(21) Appl. No.: 14/015,999

(22) Filed: Aug. 30, 2013

(65) Prior Publication Data

US 2014/0347159 A1 Nov. 27, 2014

(30) Foreign Application Priority Data

May 24, 2013 (CN) ..... 2013 1 0198753

(51) Int. Cl.

| | |
|---|---|
| ***H01F 27/36*** | (2006.01) |
| ***H01F 27/32*** | (2006.01) |
| ***H01F 5/00*** | (2006.01) |
| ***H01F 27/28*** | (2006.01) |

(52) U.S. Cl.

CPC ..... *H01F 27/289* (2013.01)

(58) Field of Classification Search

CPC ..... H01F 5/00; H01F 27/28
USPC ..... 336/200, 232, 84 R, 84 C, 84 M
See application file for complete search history.

(56) References Cited

U.S. PATENT DOCUMENTS

| | | | | |
|---|---|---|---|---|
| 5,521,573 | A * | 5/1996 | Inoh et al. | 336/180 |
| 6,023,214 | A * | 2/2000 | Ohta et al. | 336/84 R |
| 7,768,369 | B2 * | 8/2010 | Park | 336/84 C |
| 2010/0289610 | A1 * | 11/2010 | Jacobson et al. | 336/84 C |
| 2013/0200982 | A1 * | 8/2013 | Adachi et al. | 336/84 R |
| 2014/0292471 | A1 * | 10/2014 | Ho et al. | 336/84 C |

FOREIGN PATENT DOCUMENTS

| | | | |
|---|---|---|---|
| CN | 1234645 | A | 11/1999 |
| CN | 201345273 | Y | 11/2009 |
| JP | 1-110408 | U | 7/1989 |
| JP | 11-87152 | | 3/1999 |
| JP | 11-273974 | | 8/1999 |
| JP | 2002-164227 | A | 6/2002 |
| JP | 2002164227 | A * | 6/2002 |
| JP | 2009303311 | A | 12/2009 |
| JP | 2010124636 | A | 6/2010 |
| JP | 2011258876 | A * | 12/2011 |
| TW | 557459 | | 10/2003 |
| TW | 200839800 | | 10/2008 |

* cited by examiner

*Primary Examiner* — Tsz Chan
(74) *Attorney, Agent, or Firm* — CKC & Partners Co., Ltd.

(57) ABSTRACT

A transformer includes a primary winding unit, a secondary winding unit and a magnetic core. The primary winding unit includes a first input primary winding part and a first shielding winding part. The first input primary winding part is electrically connected to at least one switch component, and the first input primary winding part is electrically connected to the first shielding winding part. The secondary winding unit is inductively coupled to the primary winding unit, and the first shielding part is disposed between the first input primary winding part and the secondary winding part. Then, the primary winding unit and the secondary winding unit are assembled to the magnetic core.

18 Claims, 9 Drawing Sheets

TRANSFORMER

RELATED APPLICATIONS

This application claims priority to China Application Serial Number 201310198753. 3 filed May 24, 2013, which is herein incorporated by reference.

BACKGROUND

Technical Field

The present disclosure relates to a transformer. More particularly, the present disclosure relates to a transformer with shielding winding.

Description of Related Art

A switching power supply conducts switching operations by a switch of the power converter to control the transmission of power. However, the switching operation of the switch may generate the electromagnetic noise, and that is, the operating power converter becomes a noise source for an electrical grid and surrounding equipments. To prevent the severe interference of the noise source, global governments and the related international organizations collectively constitute EMC (electromagnetic compatibility) specification.

The electromagnetic noise includes common-mode and differential-mode noise, and there are two methods resolving the common-mode interference: attenuating the noise source and disconnecting the noise propagation path. Concerning the transformer in the power converter, a primary winding and a secondary winding form the coupling capacitance. Generally speaking, the switching power supply generates propagating interference of the common-mode noise through the coupling capacitance of the transformer.

When two opposite-phase noise co-exist in the circuit of the switching power supply, the common-mode noise of the primary winding circuit and secondary winding circuit can be mutually cancelled out by way of changing magnitude of the coupling capacitance and weakening the overall common-mode noise.

Inserting shielding layers between the primary winding and the secondary winding or adding additional compensation capacitors may change the magnitude of the coupling capacitance. However, the compensation capacitors bring additional cost, and it is not easy to balance the common-mode noise of the primary winding circuit and the secondary winding circuit. Therefore, it is more common to insert the shielding layers between the primary winding and the secondary winding.

Nonetheless, inserting the shielding layers between the primary winding and the secondary winding of the transformer increases the distance between the primary winding and the secondary winding, which magnifies the leakage inductance of the transformer. Furthermore, additional shielding layers increase size and cost of the transformer.

Accordingly, the needs of the unresolved exist in the art to address the aforementioned deficiencies and inadequacies.

SUMMARY

According to an aspect of the disclosure, a transformer is provided. The transformer includes a primary winding unit, a secondary winding unit and a magnetic core. The first input primary winding unit includes a first input primary winding part and a first shielding winding part. The first input primary winding part is electrically connected to at least one switch component, and the first input primary winding part is electrically connected to the first shielding winding part. The secondary winding unit is inductively coupled to the primary winding unit, in which the first shielding part is disposed between the first input primary winding part and the secondary winding part, and the primary winding unit and the secondary winding unit are assembled in the magnetic core.

According to another aspect of the disclosure, a transformer is provided. The transformer mentioned includes a plurality of the first primary winding circuit boards, at least one secondary winding circuit board and a magnetic core. The first primary winding circuit boards include a first shielding winding circuit board. At least one secondary winding circuit board mentioned is stacked with the first primary winding circuit boards, in which winding traces on the first shielding winding circuit board are electrically connected to a static node and close to at least one secondary winding circuit board. The first primary winding circuit boards and the at least one secondary circuit board are assembled to the magnetic core.

According to yet another aspect of the disclosure, a transformer is provided. The transformer includes a primary winding unit, a secondary winding unit and a magnetic core. The secondary winding unit is inductively coupled to the primary winding unit and includes a first secondary winding part and a first shielding winding part, in which the first secondary winding part and the first shielding winding part are electrically connected, and the first shielding winding part is disposed between the first secondary winding part and the primary winding unit. The first shielding winding part is electrically connected to a static node. The primary winding unit and the secondary winding unit are assembled to the magnetic core.

From the embodiments above, adopting the transformer in the embodiment of the disclosure does not need an additional shielding layer to meet the effect of lowering noise so as to make the size of the transformer smaller and lower the cost of the transformer. Moreover, the transformer design without an additional shielding layer can make the distance between the primary winding unit and the secondary winding unit smaller so as to decrease the leakage inductance of the transformer.

It is to be understood that both the foregoing general description and the following detailed description are by examples, and are intended to provide further explanation of the disclosure as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
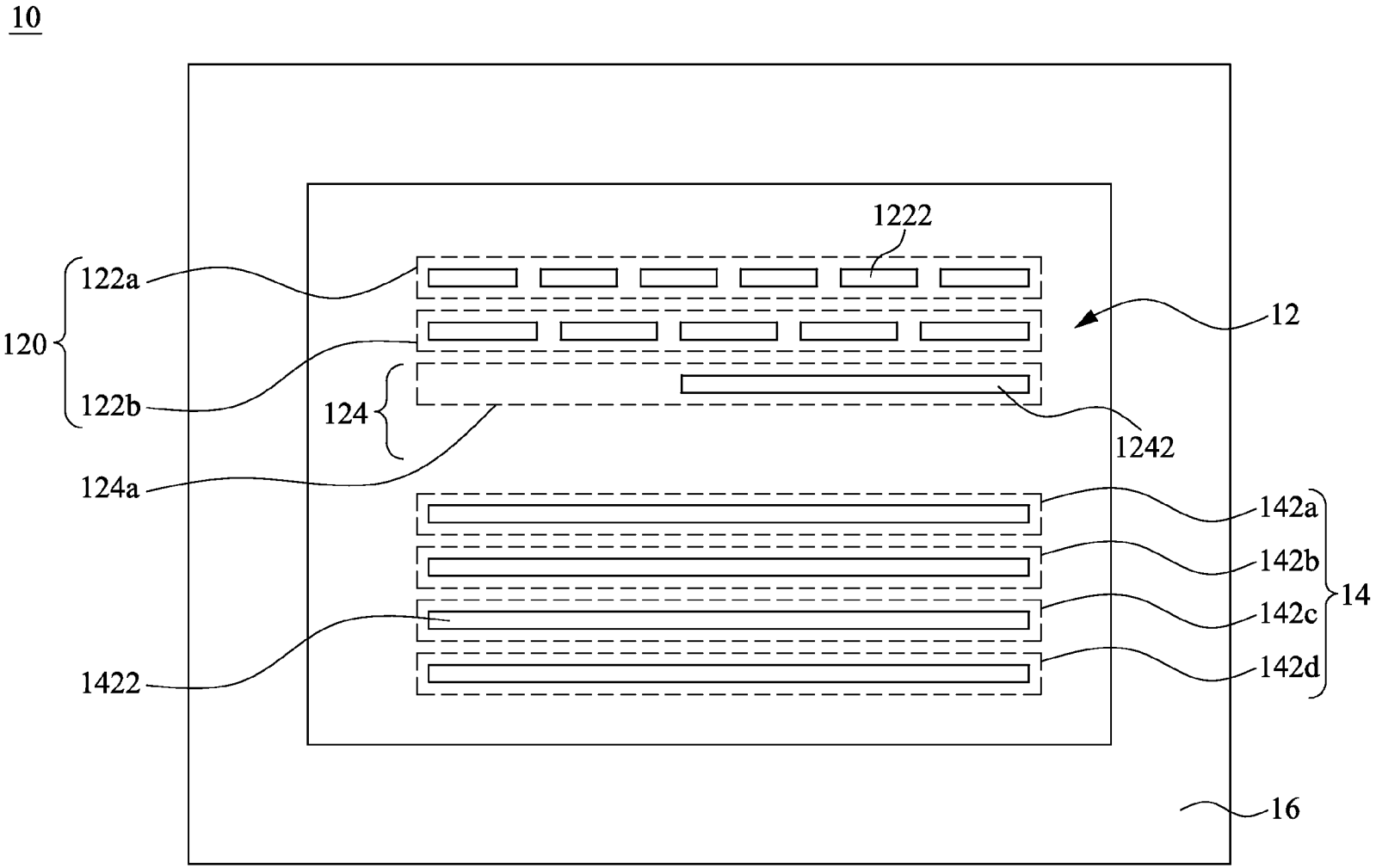
FIG. 1 illustrates a schematic block diagram of a transformer structure according to an embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

Figure 3:
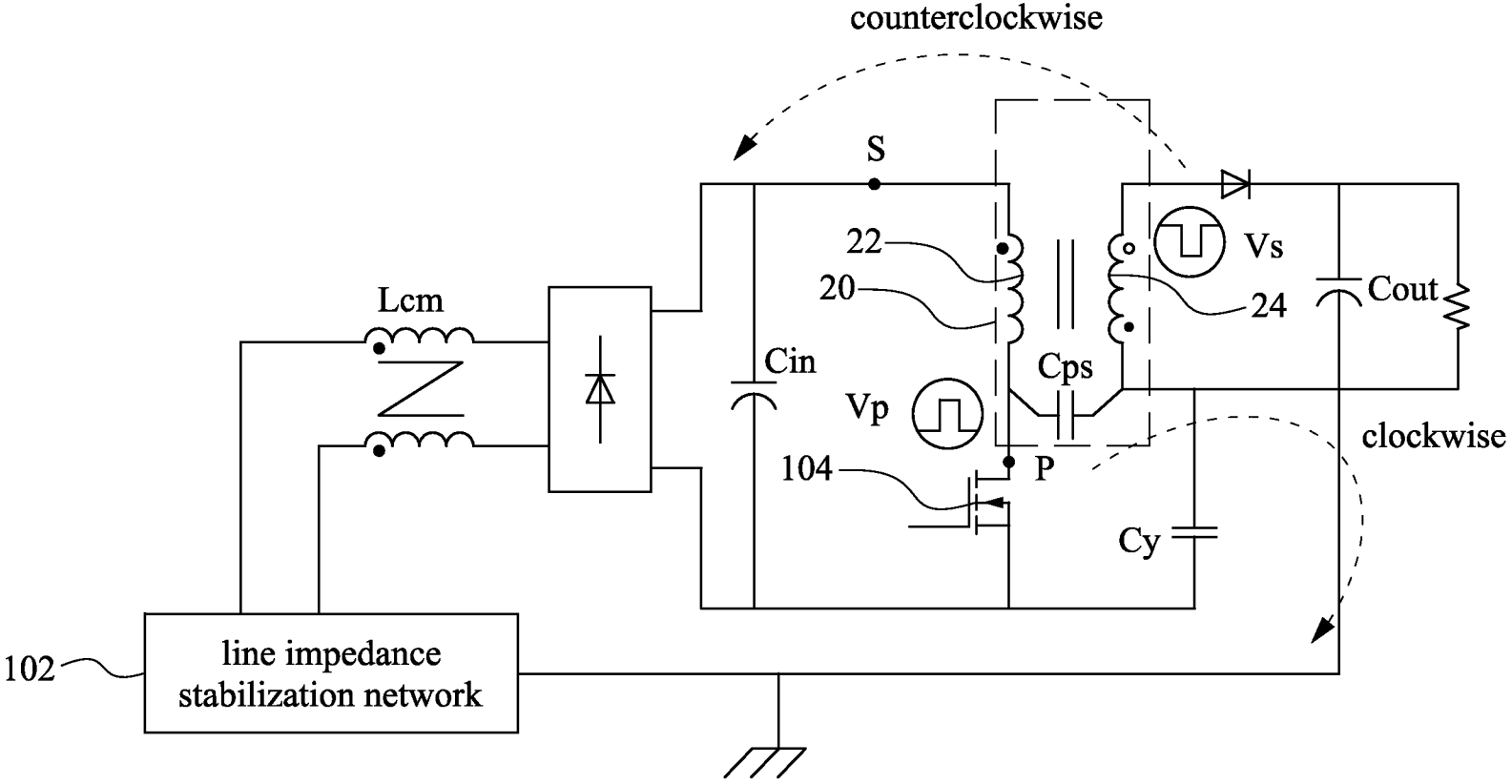
FIG. 3 illustrates a schematic circuit diagram of a transformer applied to a flyback converter and to estimating noise according to another aspect of the present disclosure.

FIG. 1 illustrates a schematic block diagram of a transformer structure according to an embodiment of the present disclosure. A transformer 10 includes a primary winding unit 12, a secondary winding unit 14 and a magnetic core 16. The primary winding unit 12 includes an input primary winding part 120 and a shielding winding part 124, in which the input primary winding part 120 is connected to at least one switch component (e.g., switch component 104 as shown in FIG. 3). The input primary winding part 120 is electrically connected to the shielding winding part 124. The secondary winding unit 14 is inductively coupled to the primary winding unit 12. The primary winding unit 12 and the secondary winding unit 14 are assembled to the magnetic core 16.

In the present embodiment, the input primary winding part 120 includes a plurality of primary winding circuit boards 122*a* and 122*b*. The primary winding circuit boards 122*a* and 122*b* are stacked with the shielding winding part 124. Each of the primary winding circuit boards 122*a* and 122*b* has winding traces 1222.

Moreover, the shielding winding part 124 includes a shielding winding circuit board 124*a* disposed between the primary winding circuit board 122*b* and the secondary winding unit 14. And the shielding winding circuit board 124*a* has winding traces 1242 which are electrically connected to a static node (e.g., a node or terminal which has no voltage jump).

Furthermore, the secondary winding unit 14 includes a plurality of secondary winding circuit boards 142*a*-142*d* and is stacked with the primary winding circuit boards. The secondary winding circuit boards 142*a*-142*d* have winding traces 1422 respectively. Furthermore, the shielding winding circuit board 124*a* is close to the secondary circuit board 142*a*.

In the embodiment shown in FIG. 1, the winding traces 1222 of the primary winding circuit boards 122*a* and 122*b* are electrically connected to the winding traces 1242 of the shielding winding circuit board 124*a* and inductively coupled to winding traces on at least one of the secondary winding circuit boards 142*a*-142*d*.

Figure 2:
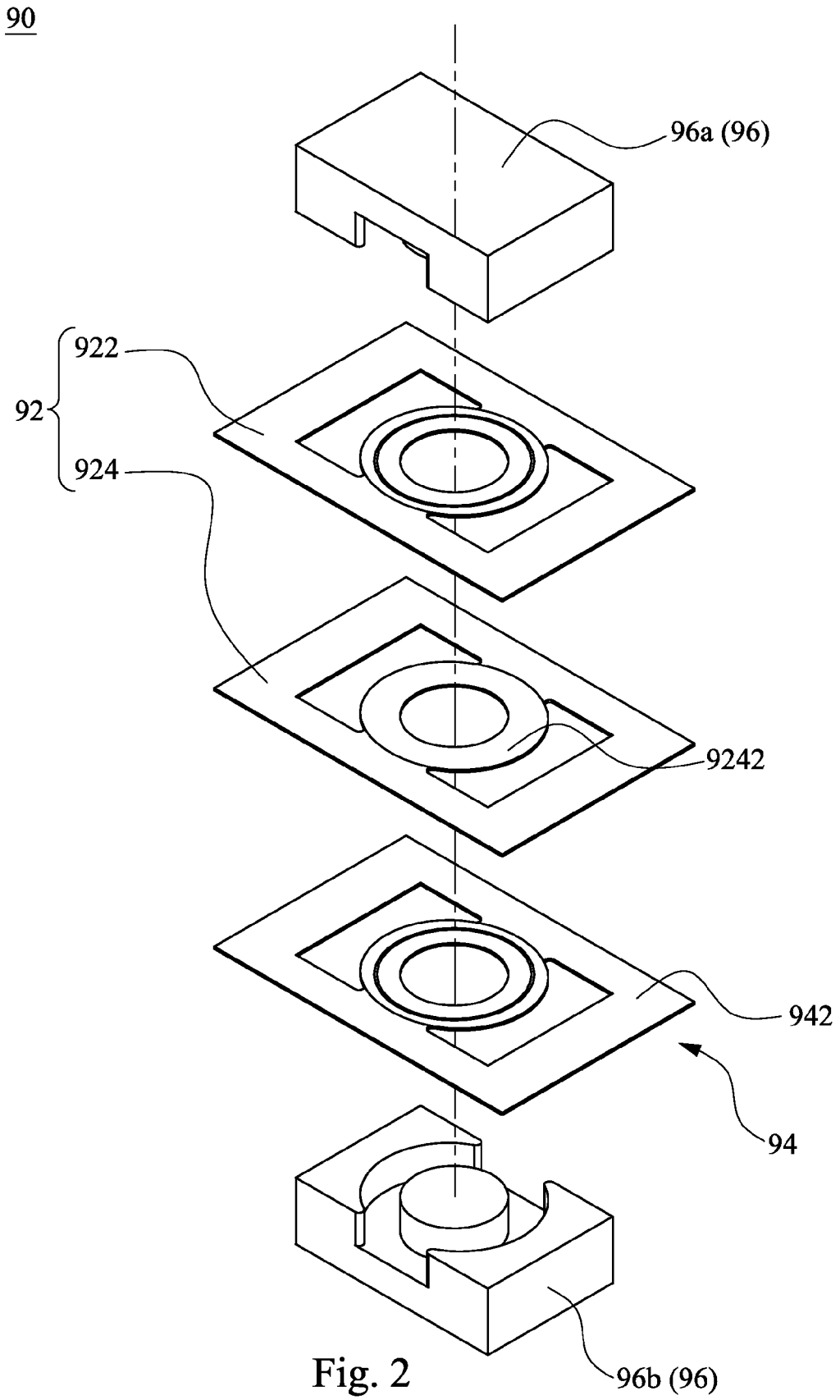
FIG. 2 illustrates a decomposition diagram of a transformer according to another embodiment of the present disclosure.

FIG. 2 illustrates a decomposition diagram of a transformer according to another embodiment of the present disclosure. The transformer 90 includes a primary winding unit 92, a secondary winding unit 94 and a magnetic core 96. The primary winding unit 92 includes a primary winding circuit board 922 and a shielding winding circuit board 924. The secondary winding unit 94 includes a secondary winding circuit board 942. The secondary winding unit 94 is inductively coupled with the primary winding unit 92. The shielding winding circuit board 924 is disposed between the primary winding circuit board 922 and the secondary winding circuit board 942 and has winding traces 9242.

The primary winding unit 92 and the secondary winding unit 94 are assembled to the magnetic core 96. Specifically, the magnetic core 96 includes an upper part 96*a* and a lower part 96*b*, in which the primary winding unit 92 and the secondary winding unit 94 are fixed between the upper part 96*a* and the lower part 96*b* of the magnetic core 96. In the circumstance of combining the upper part 96*a* and the lower part 96*b* of the magnetic core 96, the primary winding unit 92 and the secondary winding unit 94 are interlocked to the magnetic core 96.

In practice, as illustrated in FIG. 2, the primary winding circuit board 922, the shielding winding circuit board 924 and the secondary winding circuit board 942 are compressed to a multi-layer circuit board. In more details, the transformer 10 shown in FIG. 1 can be assembled using an assembling structure, which is similar to the transformer 90 shown in the embodiment.

FIG. 3 illustrates a schematic circuit diagram of a transformer applied to a flyback converter and for estimating noise according to an embodiment of the present disclosure. The transformer in the embodiments of the present disclosure is not restricted to a transformer 20 applied in the circuit shown in FIG. 3. In other words, persons of ordinary skill in the art may apply the transformer in a feed-forward converter, a buck converter, a boost converter, a buck-boost converter, a resonance converter or other similar converters.

As shown in FIG. 3, a line impedance stabilization network (LISN) 102 is often configured to measure the noise of the device. In the present embodiment, the LISN 102 measures the noise produced by the flyback converter to which the transformer 20 is applied. In the transformer 20 shown in the embodiment, one terminal of a primary winding unit 22 is electrically connected to a switch component 104 through a dynamic node P (which is for voltage hopping when the system is operating), and the other terminal of the primary winding unit 22 is electrically connected to the capacitance component Cin through a static node S. There is a coupling capacitance Cps between the primary winding unit 22 and a secondary winding unit 24. The dynamic node P has a significant voltage variation due to the switch operation of the switch component 104, and the static node S is connected to the capacitance component Cin to have a stable voltage.

In the case of the transformer 10 shown in FIG. 1 combined with the circuit shown in FIG. 3, the shielding winding part 124 is electrically connected to the static node S shown in FIG. 3. Specifically, the winding traces 1242 on the shielding winding circuit board 124*a* of the shielding winding part 124 are electrically connected to the static node S. The input primary winding part 120 is electrically connected to the switch component 104 shown in FIG. 3 through one of the winding traces on the primary winding circuit boards 122*a* and 122*b*. Therefore, compared to the input primary winding part 120, the shielding winding part 124 has a more stable voltage. Therefore, the shielding winding part 124 can provide the shielding effect between the input primary winding part 120 and the secondary winding unit 14, and an additional shielding layer is unnecessary.

What needs to be explained is that in the primary winding circuit boards 122*a* and 122*b*, the primary winding circuit board 122*a* is the furthest away from the secondary winding circuit board 142*a*. Thus, winding traces on the primary winding circuit board 122*a* and the switch component 104 are electrically connected, such that the dynamic node is furthest away from the secondary winding unit 14, to lower the noise transmitted from the primary winding unit 12 to the secondary winding unit 14.

Furthermore, the static node S shown in FIG. 3 is not restricted to be connected to the capacitance component Cin. For example, in the circumstance that the transformer in the embodiment of the present disclosure is applied to an LLC resonance converter, the shielding winding unit or winding traces on the shielding winding circuit board can be connected to the ground terminal through the static node S. In other embodiments, the shielding winding parts of the transformer or winding traces on the shielding winding circuit board may also be connected to the direct-current (DC) bus through the static node S.

The following descriptions illustrate a noise propagation path of the transformer shown in the embodiment of the present disclosure based on FIG. 3. Corresponding to the switch operation of the switch component 104, a noise source Vp of the primary circuit generates the noise and transmits it to the secondary circuit through the coupling capacitance Cps. The noise is then inputted to the LISN 102 through a grounding line. In the mean time, a noise source Vs of the secondary circuit generates the noise, and then the noise is inputted to the LISN 102. The directions of the noise generated from the noise source Vp of the primary circuit and the noise generated from the noise source Vs of the secondary circuit are complementary. Hence, adjusting the coupling capacitance Cps may change the relative strength of noises of the primary circuit and the secondary circuit being mutually coupled.

In the circumstance of the maximum coupling capacitance Cps, the voltage variation of the primary winding unit 22 is the largest. Thus, the strength of noise that is generated from the noise source Vp of the primary circuit and coupled to the secondary circuit is the strongest. In the circumstance of the minimum coupling capacitance, the noise of the primary winding unit 22 is totally shielded, and the strength of noise, which is generated from the noise source Vs of the secondary circuit, coupled to the primary circuit is the strongest. Therefore, in the circumstance of the coupling capacitance Cps having an appropriate value, the strengths of the noise mutually coupled by the primary circuit and by the secondary circuit are about the same, and the noise can be mutually cancelled so as to lower the noise as a whole.

Taking the transformer 10 shown in FIG. 1 for example, since the shielding circuit board 124*a* provides the shielding effect between input primary winding part 120 and the secondary winding unit 14, adjusting the diameter of the winding traces 1242 can change the coupling capacitance (Cps shown in FIG. 3) of the primary circuit 12 and the secondary circuit 14 so as to lower the noise as a whole.

Specifically, the winding traces 1242 on the shielding winding circuit board 124*a* has a diameter corresponding to the smallest metal width in the circuit board manufacturing process, such that the winding traces 1242 have the smallest possessed area and the weakest shielding effect, and the coupling capacitance between the primary winding unit 12 and the secondary winding unit 14 is maximum. In contrast, winding traces 1242 on the shielding winding circuit board 124*a* have a wire diameter corresponding to the largest metal conforming to a window size of the transformer 10. This not only makes the winding traces 1242 have the largest possessed area and the strongest shielding effect but also minimizes the coupling capacitance between the primary winding unit and the secondary winding unit. The wire diameter of the winding traces 1242 can be adjusted in the range from the smallest to the largest metal width to lower the noise as a whole according to the requirements (e.g. the design specification of the transformer).

From the embodiment mentioned above, adopting the transformer in the embodiment of the present disclosure may achieve the effect of lowering noise without an additional shielding layer, such that the size of the transformer is small and the cost of the transformer is reduced. The plane transformer in the present disclosure can be manufactured in mass production, which lowers the manufacturing cost.

Moreover, the transformer design without an additional shielding layer makes the distance between the primary winding unit and the secondary winding unit smaller, and further decreases the leakage inductance of the transformer. For example, if the primary winding unit and the secondary winding unit have 24 and 4 turns of winding traces respectively, the transformer shown in the embodiment of the present disclosure can lower around 25% leakage inductance and around 20% cost compared to the transformer with additional shielding layers.

Figure 4A:
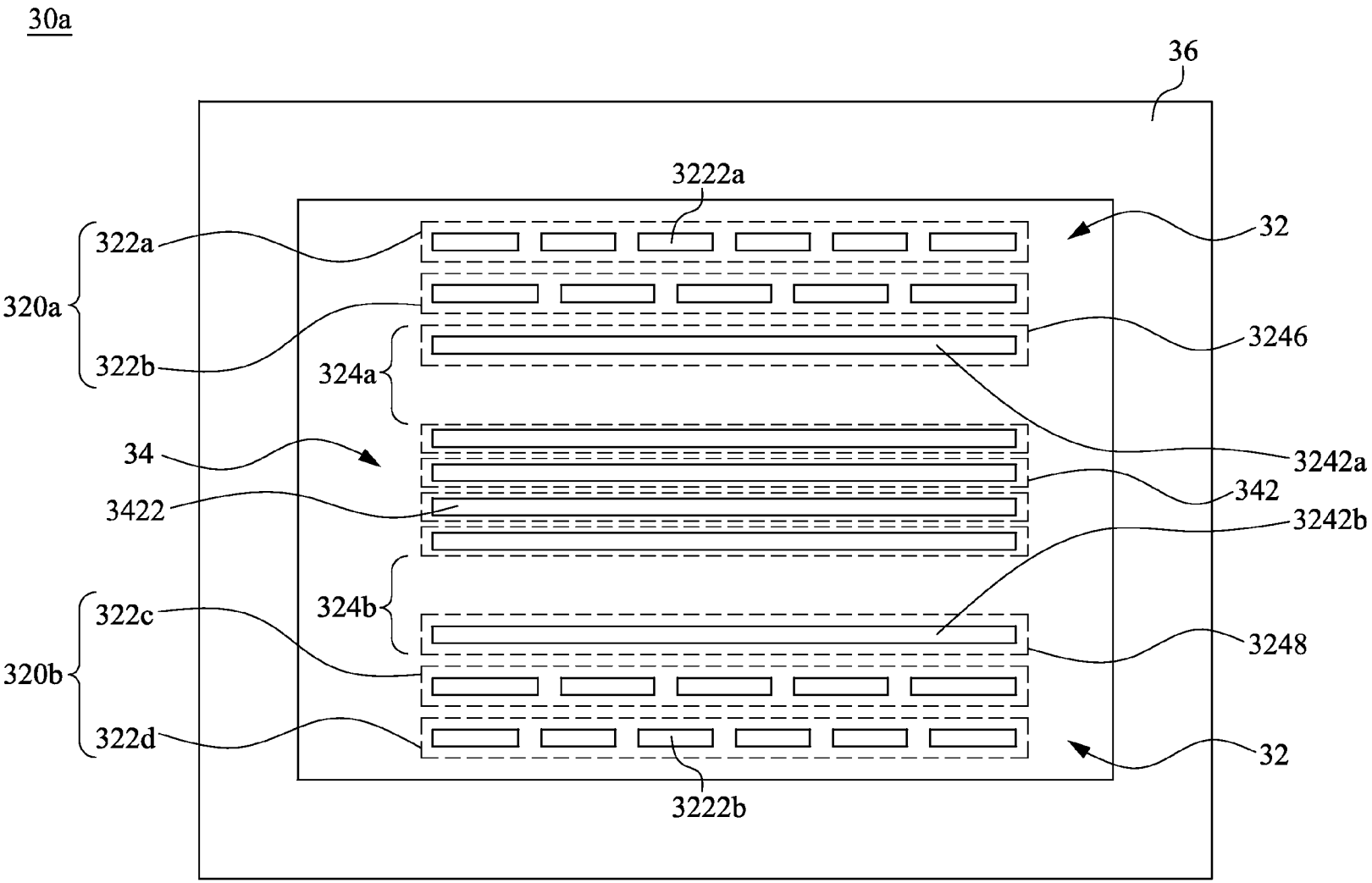
FIG. 4A illustrates a schematic block diagram of a transformer structure according to another embodiment of the present disclosure.

FIG. 4A illustrates a schematic block diagram of a transformer structure according to another embodiment of the present disclosure. Compared to FIG. 1, the transformer 30*a* is a plane transformer of a sandwich structure. The transformer 30*a* includes a primary winding unit 32, a secondary winding unit 34 and a magnetic core 36. As shown in FIG. 4A, in addition to a input primary winding part 320*a* disposed above the secondary shielding unit 34 and a shielding winding part 324*a* comprising a shielding winding circuit board 3246, the primary shielding unit 32 further includes an input primary winding unit 320*b* below the secondary winding unit 34 and a shielding winding part 324*b* of another shielding winding circuit board 3248, in which the input primary winding part 320*a*, the shielding winding part 324*a*, the shielding winding part 324*b* and the input primary winding part 320*b* are electrically connected (i.e., winding traces on the input primary winding part 320*a*, the shielding winding part 324*a*, the shielding winding part 324*b* and the input primary winding part 320*b* are electrically connected in series). The aforementioned shielding part 324*b* is disposed between the input primary winding part 320*b* and the secondary winding unit 34, and the two shielding winding parts 324*a* and 324*b* of the transformer 30*a* are respectively disposed on the two opposite sides of the secondary winding unit 34.

In the present embodiment, one of the shielding winding part 324*a* and the shielding winding part 324*b* of the transformer 30*a* is electrically connected to the static node (such as the static node S shown in FIG. 3), and the two shielding winding parts 324*a* and 324*b* are electrically connected.

In one embodiment, the two shielding winding parts 324*a* and 324*b* of the transformer 30*a* include the shielding winding circuit boards 3246 and 3248 respectively. The shielding winding circuit boards 3246 and 3248 further include the winding traces 3242*a* and 3242*b*, respectively. Likewise, the winding traces 3242*a* on the shielding winding circuit board 3246 and the winding traces 3242*b* on the shielding winding circuit board 3248 can be electrically connected to a static node. Specifically, one set of the winding traces 3242*a* and 3242*b* is electrically connected to the DC power bus outside the transformer, the ground terminal outside the transformer, or the like.

The input primary winding part 320*a* further includes primary winding circuit 322*a* and 322*b*, and the primary winding part circuit boards 322*a* and 322*b* are stacked with the shielding winding circuit board 3246 of the shielding winding part 324*a*. In the similar situation, the input primary part 320*b* further includes primary winding circuit boards 322*c* and 322*d*, and the primary winding circuit boards 322*c* and 322*d* are stacked with the shielding winding circuit board 3248 of the shielding winding part 324*b*. In practice, the primary winding circuit boards 322*a*, 322*b*, 322*c* and 322*d*, the shielding winding part circuit boards 3246 and 3248 and the winding circuit boards of the secondary winding unit 34 (e.g., the secondary winding circuit board 342 as shown in FIG. 4A) are compressed to a multi-layer circuit board.

In the embodiment of FIG. 4A, each set of the winding traces 3242*a* and 3242*b* on the shielding winding circuit boards 3246 and 3248 has a wire diameter conforming to a window size of the transformer, which minimizes the coupling capacitance.

Figure 4B:
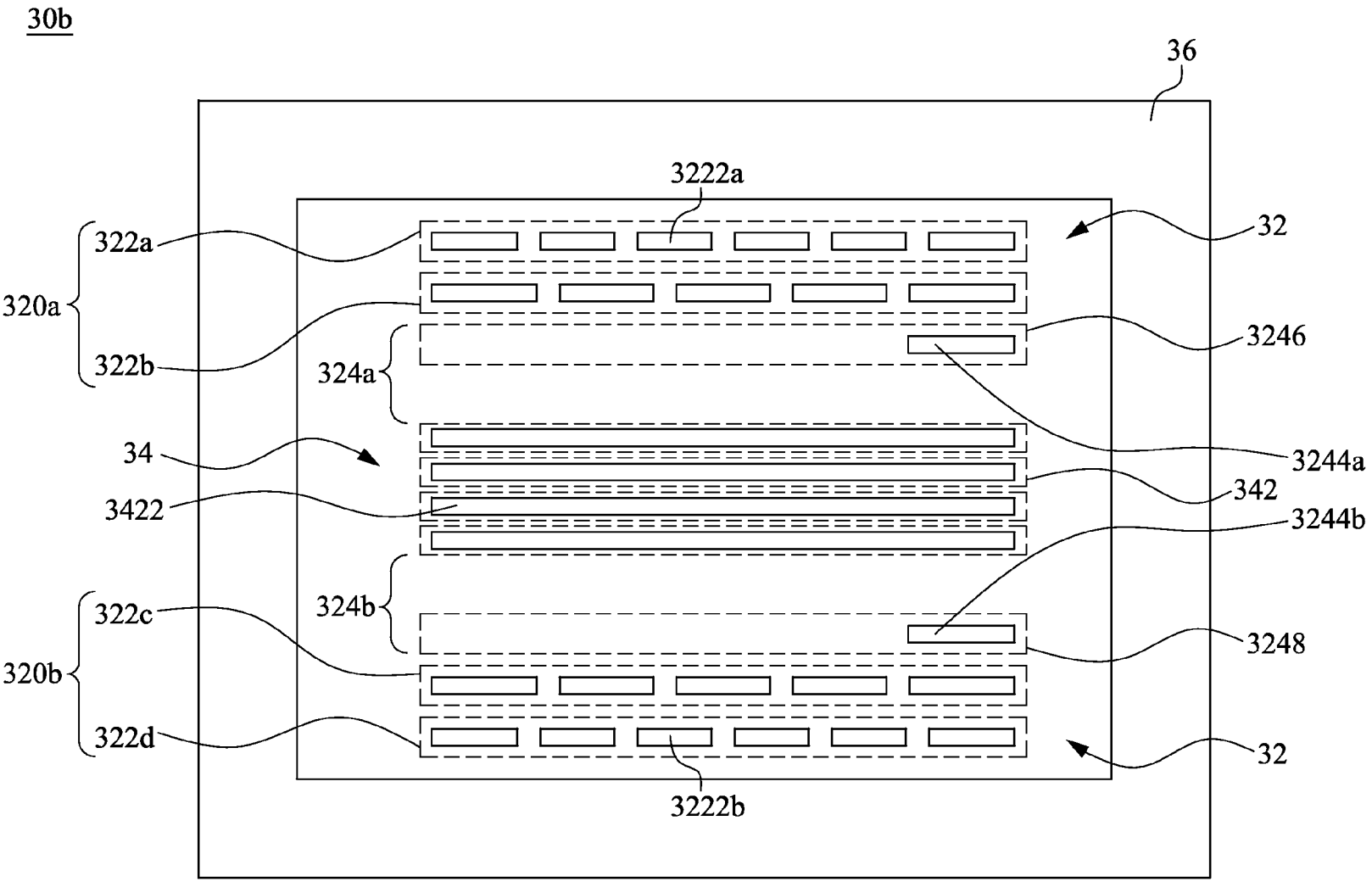
FIG. 4B illustrates a schematic block diagram of a transformer structure according to another embodiment of the present disclosure.

FIG. 4B illustrates a schematic block diagram of a transformer structure according to another embodiment of the present disclosure. Compared to FIG. 4A, winding traces 3244*a* and 3244*b* on the shielding winding part circuit boards 3246 and 3248 have a wire diameter corresponding to the smallest metal width in the circuit board manufacturing process, which maximizes the coupling capacitance between the primary winding unit 32 and the secondary winding unit 34 of the transformer 30*b*.

Figure 4C:
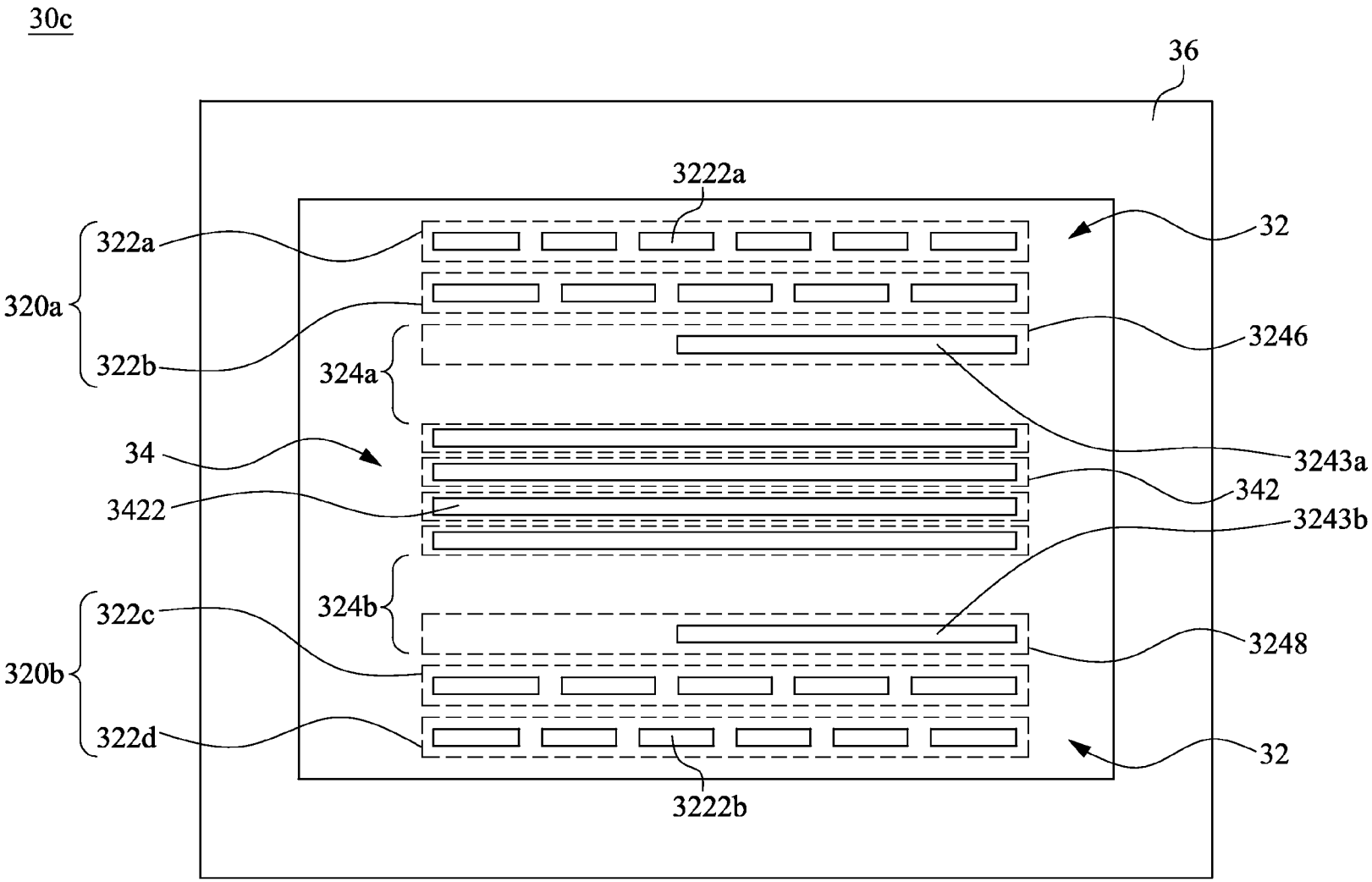
FIG. 4C illustrates a schematic block diagram of a transformer structure according to another embodiment of the present disclosure.

FIG. 4C illustrates a schematic block diagram of a transformer structure according to another embodiment of the present disclosure. Compared to FIG. 4A and FIG. 4B, winding traces 3243*a* and 3243*b* on shielding winding part circuit boards 3246 and 3248 have a wire diameter between the wire diameters of the winding traces 3242*a* shown in FIG. 4A and winding traces 3244*a* shown in FIG. 4B. Therefore, wire diameter of the winding traces 3243*a* and 3243*b* can be adjusted within the range from the aforesaid smallest metal width to the aforesaid largest metal width, which sets the coupling capacitance between the primary winding unit and the secondary winding unit a certain value and minimizes the noise as a whole.

For example, transformer adopts the magnetic core EQ25 in the testing environment of FIG. 3. In the circumstance that the primary winding circuit unit and the secondary winding unit have 14 and 2 turns of winding traces respectively, when winding traces on the shielding winding circuit board have the wire diameter corresponding to the smallest metal width in the circuit board manufacturing process, noise of the primary circuit is stronger, which makes noise level measured by the LISN 102 exceed a required level in the noise regulation (e.g., regulation requirement which the Comité International Spécial des Perturbations Radioélectriques makes in chapter 22) by 6 dB. When the winding traces on the shielding winding circuit board have a wire meter corresponding to the largest metal width conforming the window size of the transformer, noise of the secondary circuit is stronger and makes the noise level measured by the LISN 102 exceeds the required level in the noise regulation by 10 dB. When wire diameter of the winding traces on the shielding winding circuit board can be set to balance noise of the primary circuit and noise of the secondary circuit, the noise level measured by the LISN 102 is lower than the required level in the noise regulation by 8 dB, which illustrates that the transformer adopting the technique of the present disclosure can lower the noise and prevent producing interference to the surrounding equipments.

What needs to be explained is that the wire diameter variation of the winding traces on the shielding winding circuit boards shown in FIG. 4A to FIG. 4C not only can be applied to, but not limited to, the transformers shown in FIG. 4A to FIG. 4C but also can be applied to the transformers shown in the other embodiments of the present disclosure (e.g., the wire diameter of the winding traces 9242 shown in FIG. 2).

Figure 5:
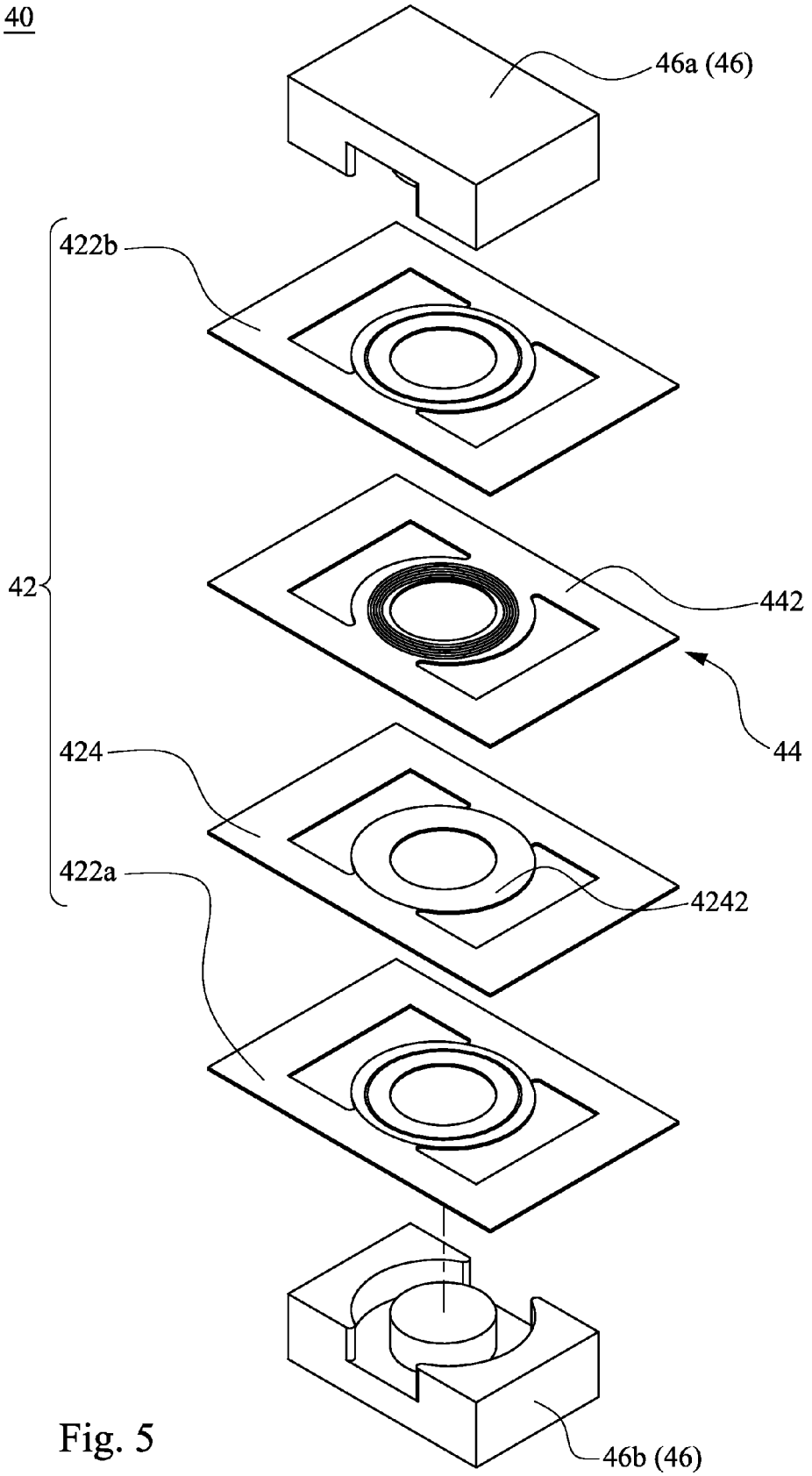
FIG. 5 illustrates a decomposition diagram of a transformer structure according to another embodiment of the present disclosure.

FIG. 5 illustrates a decomposition diagram of a transformer structure according to another embodiment of the present disclosure. The transformer 40 includes a primary winding unit 42, a secondary winding unit 44 and a magnetic core 46 (the magnetic core 46 shown in FIG. 5 includes an upper part 46*a* and a lower part 46*b*). The primary winding unit 42 includes a primary winding circuit board 422*a*, a primary winding circuit board 422*b* and a shielding winding circuit board 424. The secondary winding unit 44 includes a secondary winding circuit board 442 configured to be inductively coupled to the primary winding unit. The shielding winding circuit board 424 is electrically connected to the DC bus and disposed between a primary winding circuit board 422*a* and a secondary winding circuit board 442. The primary winding unit 42 and the secondary winding unit 44 are assembled to upper part 46*a* and lower part 46*b* of the magnetic core 46 respectively.

Compared to the embodiments shown in FIG. 4A to FIG. 4C, there are no shielding winding circuit boards disposed between the primary winding circuit board 422*b* and the secondary winding circuit board 442. In other words, the transformer shown in the embodiment of the present disclosure does not need symmetrically disposed shielding winding parts (or the symmetrically disposed shielding winding circuit boards) to lower the noise as a whole of the transformer, which makes the design of the transformer more flexible.

In another aspect of the present disclosure, a transformer is provided. In order to illustrate more conveniently, the following embodiment takes the flyback converter shown in FIG. 3 to which the transformer 10 shown in FIG. 1 is applied for example. But the present disclosure is not restricted to the present embodiment.

The transformer 10 includes a plurality of primary winding circuit boards, the secondary winding circuit boards 142*a*-142*d* and the magnetic core 16. The primary winding circuit board includes the shielding winding circuit board 124*a*. The secondary winding boards 142*a*-142*d* are stacked with aforesaid primary winding circuit boards (including the primary winding circuit boards 122*a*, 122*b* and the shielding winding circuit board 124*a*), in which the winding traces 1242 on the shielding winding board 124*a* are electrically connected to the static node S (shown in FIG. 3), and the shielding circuit board 124*a* is close to the secondary winding circuit board 142*a*. The aforesaid primary winding circuit boards (including the primary winding circuit boards 122*a*, 122*b* and the shielding winding circuit board 124*a*) and the secondary winding circuit boards 142*a*-142*d* are assembled to the magnetic core 16.

In one embodiment, winding traces 1222 on the primary winding circuit boards 122*a*, 122*b* are electrically connected to the winding traces 1242 on the shielding winding circuit board 124*a* and inductively coupled to winding traces 1422 on at least one of the secondary winding circuit boards 142*a*-142*d*.

In practice, as shown in FIG. 1, the primary winding circuit boards 122*a*, 122*b*, the shielding winding circuit board 124*a* and the secondary winding circuit boards 142*a*-142*d* are compressed to a multi-layer circuit board.

In the aforesaid primary winding circuit boards, winding traces on the furthest primary winding circuit board 122*a* from the secondary winding circuit board 142*a* are electrically connected to the switch component 104 (shown in FIG. 3) such that the dynamic point P is the furthest from the secondary winding circuit boards 142*a*-142*d*, which lower the noise transmitted from the all the aforesaid primary winding circuit boards to the secondary winding circuit boards 142*a*-142*d*.

In one embodiment, winding traces 1242 on the shielding winding circuit board 124*a* are electrically connected to a static node, and the static node can be one of a ground terminal and a DC bus such that the shielding winding circuit board 124*a* has stable voltage and then provide the shielding effect. In the embodiment shown in FIG. 3, winding traces 1242 on the shielding winding circuit board 124*a* are electrically connected to the capacitance element Cin (i.e. on the DC bus).

In another embodiment, winding traces 1242 on the shielding windings circuit board 124*a* may have a wire diameter corresponding to a smallest metal width in the circuit board manufacturing process or to a largest metal width conforming a window size of the transformer 10. And the wire diameter can be adjusted within the range from the smallest metal width to the largest metal width so as to minimize the noise as a whole of the transformer. The winding traces 1242 are similar to the winding traces on the shielding circuit boards 3246, 3248 as shown in FIG. 4A-FIG. 4C, therefore detailed descriptions of winding traces are stated as above and no longer repeated here.

In FIG. 4A, compared to the transformer 10 shown in FIG. 1, in addition to the primary winding circuit boards 322*a*-322*b* and the shielding winding circuit board 3246 above the secondary winding circuit boards 342, the transformer 30*a* further includes a plurality of primary winding circuit boards (including the primary winding circuit boards 322*c*, 322*d* and a shielding winding circuit board 3248) below the secondary winding circuit boards 342. The primary winding circuit boards 322*c*, 322*d*, 3248 are stacked in relative to the primary winding circuit boards (including the primary winding circuit board 322*a*, 322*b* and a shield winding circuit board 3246) above the secondary winding circuit board. The plurality of secondary winding circuit boards 342 are stacked between the primary winding circuit board (including the primary winding circuit board 322*a*, 322*b* and a shield winding circuit board 3246) disposed at the top and the primary winding circuit board (including the primary winding circuit boards 322*c*, 322*d* and a shielding winding circuit board 3248) disposed at the bottom. The primary winding circuit board disposed at the bottom includes the shielding circuit board 3248, and the winding traces 3242*b* on the shielding circuit board 3248 are electrically connected to the winding traces 3242*a* on the shielding circuit board 3246. Winding traces on either the shielding winding circuit board 3248 or the shielding winding circuit board 3246 are electrically connected to the static node (e.g., the static node S shown in FIG. 3) and close to the secondary winding circuit boards 342.

In one embodiment, winding traces 3222*a* on the primary winding circuit boards 322*a* and 322*b* are electrically connected to winding traces 3242*a* on the shielding winding circuit 3246. Winding traces 3222*b* on the primary winding circuit boards 322*c*, 322*d* are electrically connected to winding traces 3242*b* on the shielding winding circuit board 3248 and inductively coupled to at least one secondary winding circuit board 342.

In one embodiment, winding traces on the shielding circuit boards 3246, 3248 are electrically connected to one of the ground terminal and the DC bus such that the shielding winding circuit boards 3246, 3248 have the stable voltage and then provide shielding effect.

In another embodiment, the winding traces 3242*a*, 3242*b* on the shielding winding circuit boards 3246, 3248 have a wire diameter corresponding to the largest metal width conforming the window size of the transformer 30*a*, to the smallest metal width in the circuit board manufacturing process, or to size adjusted within a range between the largest metal width and the smallest metal width according to the practical requirement. The variation in the wire diameter is shown in FIG. 4A-FIG. 4C, therefore detailed descriptions of variation in the wire diameter are stated as above and no longer repeated here.

From the embodiments above, adopting the transformers in the embodiment of the present disclosure may achieve the effect of lowering noise without an additional shielding layer such that the size of the transformer is small and the cost of the transformer. The plane transformer in the present disclosure can be manufactured in mass production so as to lower the manufacturing cost.

Moreover, the transformer design without an additional shielding layer may make the distance between the primary winding unit and the secondary winding unit smaller, and it can also decrease the leakage inductance of the transformer. For example, if the primary winding unit and the secondary winding unit respectively have 24 and 4 turns of winding traces, the transformer shown in the embodiment of the present disclosure can lower about 25% leakage inductance and about 20% cost compared to the transformer with additional shielding layers.

Figure 6:
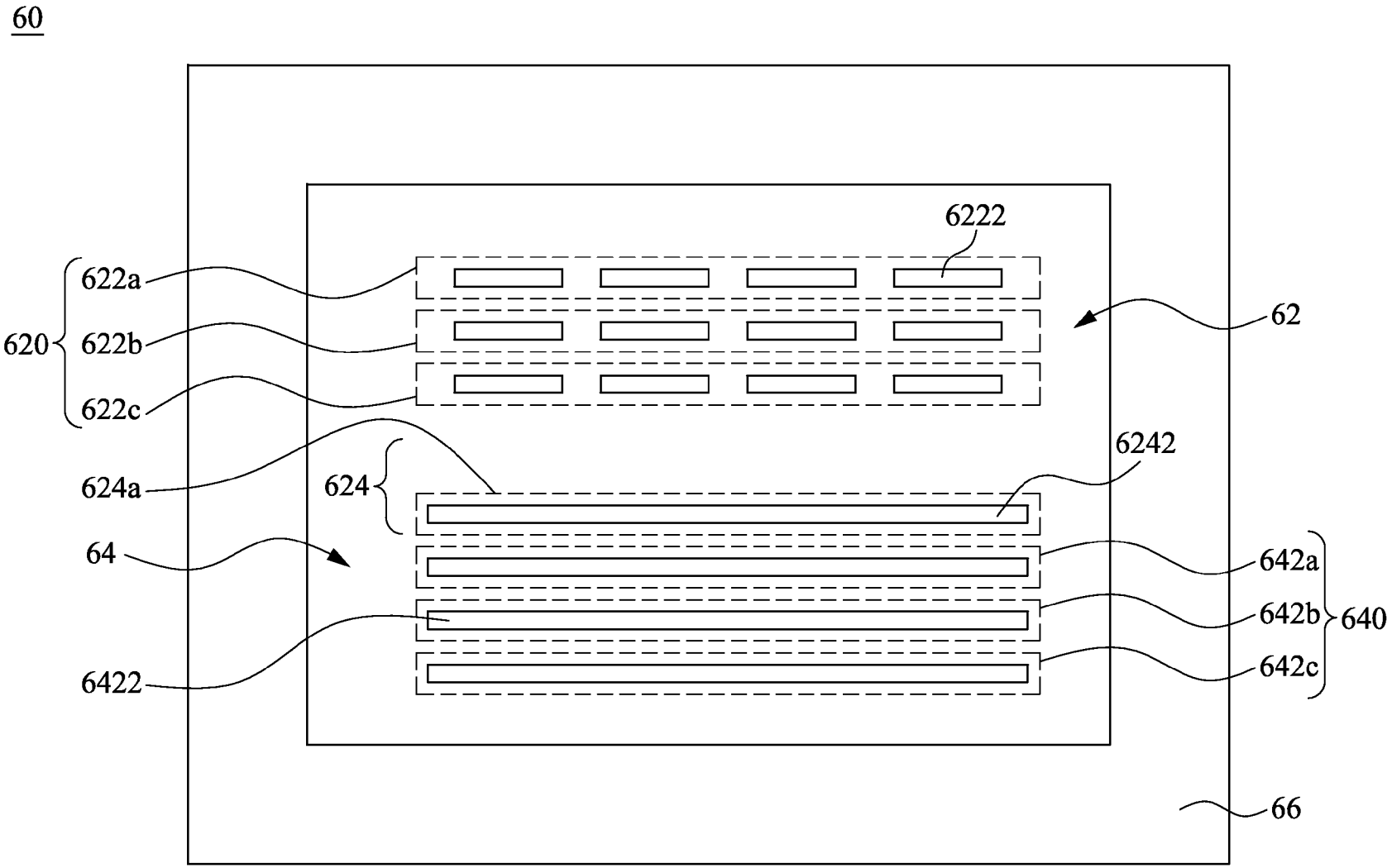
FIG. 6 illustrates a schematic block diagram of a transformer structure according to another embodiment of the present disclosure.

According to still another aspect of the present disclosure, a transformer is provided. Taking FIG. 6 for example, FIG. 6 illustrates a schematic block diagram of a transformer structure according to the transformer structure in another embodiment of the present disclosure. The transformer 60 includes a primary winding unit 62, a secondary winding unit 64 and a magnetic core 66. The secondary winding unit 64 is inductively coupled to the primary winding unit 62.

Compared to the transformer mentioned in the above embodiments, the secondary winding unit in the present embodiment includes a secondary winding part 640 and a shielding winding part 624, in which the secondary winding part 640 and the shielding winding part 624 are electrically connected to each other, and the shielding winding part 624 are disposed between the secondary winding part 640 and the primary winding unit 62. The shielding winding part 624 is electrically connected to the static node. The static node can be connected to an output terminal, which can be one side of the capacitance or the ground terminal, shown in FIG. 3. The primary winding unit 62 and the secondary winding unit 64 are assembled to the magnetic core 66, and the primary winding unit 62 and the secondary winding unit 64 are inductively coupled.

Moreover, the shielding winding part 624 further includes but not limited to the shielding winding circuit board 624*a*, and the shielding winding part 624 may also have a plurality of shielding winding circuit boards in other embodiments.

In one embodiment, the shielding winding circuit board 624*a* has the winding traces 6242, and the winding traces 6242 are electrically connected to the ground terminal or the output terminal, e.g., the capacitance component shown in FIG. 3.

In another embodiment, the secondary winding part 640 further includes a plurality of secondary winding circuit boards 624*a*, 624*b* and 624*c*, and the secondary winding circuit boards 624*a*, 624*b* and 624*c* and the shielding winding part 624 are stacked. Moreover, the primary winding unit 62 includes the input winding part 620, and the input primary winding part 620 includes a plurality of primary winding circuit boards 624*a*, 624*b* and 624*c*.

Operation of the transformer 60 shown in FIG. 6 is similar to operation of the transformer 10 shown in FIG. 1, therefore detailed descriptions of operation are stated as above and no longer repeated here.

According to another aspect of the present disclosure, a transformer is provided. Taking FIG. 6 for example, the transformer 60 includes primary winding circuit boards 622*a*-622*c*, a plurality of secondary circuit boards and a magnetic core 66. The plurality of secondary winding circuit boards include the shielding winding circuit board 624*a* and the secondary winding circuit boards 642*a*-642*c*. The shielding winding circuit board 624*a* and the secondary winding circuit boards 642*a*-642*c* are stacked with the primary winding circuit boards 622*a*-622*c*, in which the winding traces 6242 on the shielding winding circuit board 624*a* are electrically connected to the static node (e.g., the static node S shown in FIG. 3), and the shielding winding circuit board 624*a* is close to the primary winding circuit board 622*c*. The primary winding circuit boards 622*a*-622*c*, the shielding winding circuit board 624*a* and the secondary winding circuit boards 642*a*-642*c* are assembled to the magnetic core 66.

In one embodiment, the winding traces 6422 on the secondary winding circuit boards 642*a*-642*c* are electrically connected to the winding traces 6242 on the shielding winding circuit board 624*a* and inductively coupled to the winding traces 6222 on at least one of the primary circuit boards 622*a*-622*c*.

In practice, as shown in FIG. 6, the primary winding circuit boards 622*a*-622*c*, the shielding winding circuit board 624*a* and the secondary winding circuit board 642*a*-642*c* are compressed to a multi-layer circuit board.

In the aforesaid primary winding circuit boards, the winding traces 6422 on the secondary winding circuit board 642*c*, which is the furthest from the primary winding circuit board 622*c*, are electrically connected to the switch component so as to lower the noise transmitted from all aforesaid the secondary circuit boards to the primary circuit board is then reduced.

In one embodiment, a static node to which winding traces 6242 on the shielding winding circuit board 624*a* are connected is one of the ground terminal and the output terminal, e.g., one side of the capacitance component Cout shown in FIG. 3. Thereby, the shielding winding circuit board 624*a* has the stable voltage and then provides the shielding effect.

In another embodiment, the winding traces 6242 on the shielding winding circuit board 624*a* have a wire diameter corresponding to the smallest metal width in the circuit board manufacturing process, or to the largest metal width conforming the window size of the transformer 60. The wire diameter can also be adjusted in the range from the smallest to the largest metal width so as to lower the noise as a whole of the transformer 60. The winding traces 6242 are similar to the winding traces on the shielding winding circuit boards 3246, 3248 in FIG. 4A-FIG. 4C, therefore detailed descriptions of winding traces are stated as above and no longer repeated here.

Figure 7:
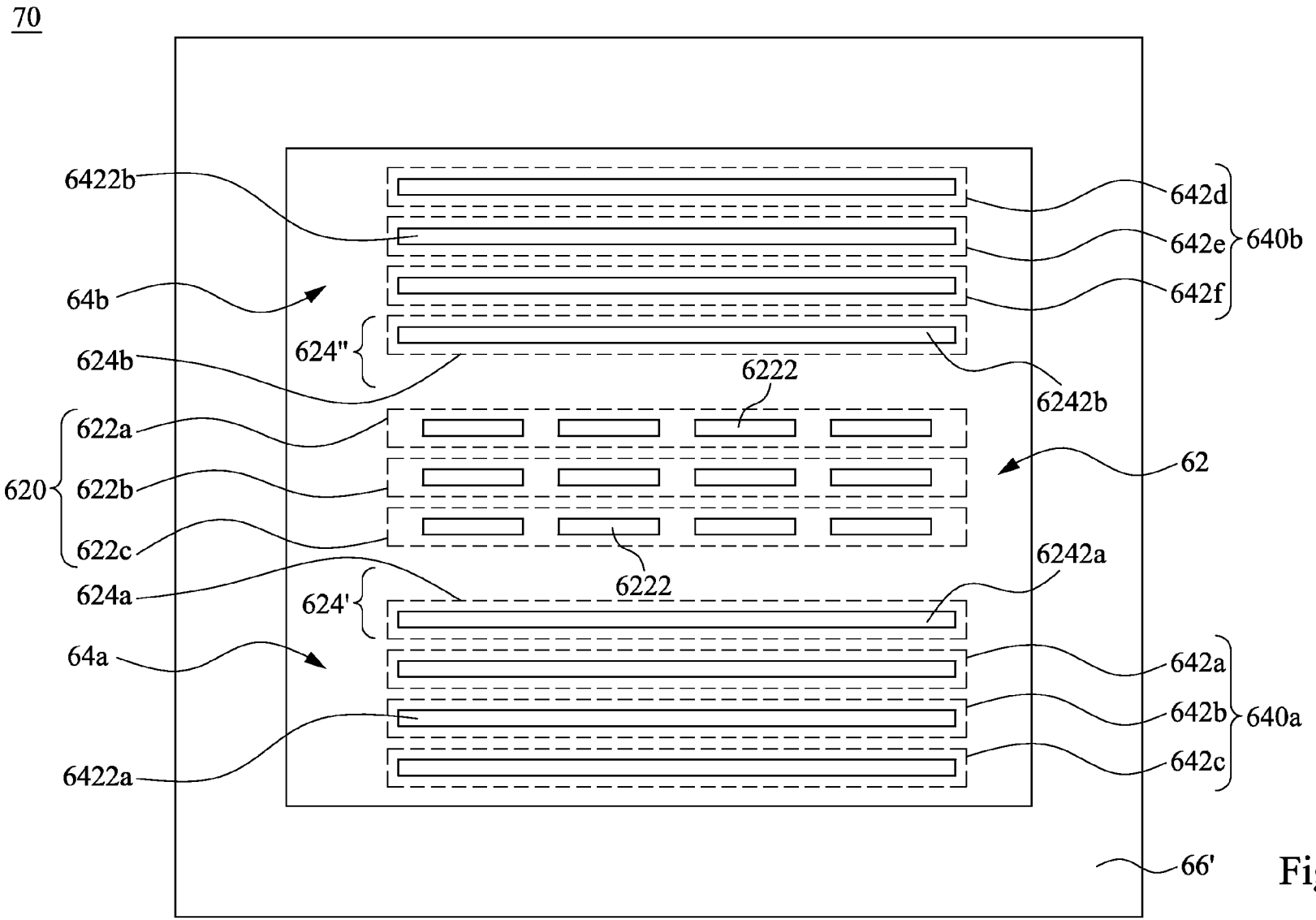
FIG. 7 illustrates a schematic block diagram of a transformer structure according to another embodiment of the present disclosure.

FIG. 7 illustrates a schematic block diagram of a transformer structure according to another embodiment of the present disclosure. The transformer 70 includes secondary winding units 64*a*, 64*b* and a magnetic core 66'. The secondary winding unit 64*a* includes a secondary winding part 640*a* and a shielding winding part 624'. The secondary winding unit 64*b* includes a secondary winding part 640*b* and a shielding winding part 624". Compared to the transformer 60 shown in FIG. 6, the transformer 70 further includes a plurality of secondary winding circuit boards (including secondary winding circuit boards 642*d*-642*f* and a shielding winding circuit board 642*b*) above the primary winding circuit boards 622*a*-622*c* in addition to secondary winding circuit boards (including the shielding winding circuit board 624*a* and the secondary winding circuit boards 642*a*-642*c*) below the primary winding circuit boards 622*a*-622*c*. The secondary winding circuit boards (including the shielding winding circuit board 624*a* and the secondary winding circuit boards 642*a*-642*c*) above the primary winding circuit boards 622*a*-622*c* are stacked in relative to the secondary winding circuit boards (including the shielding winding circuit board 624*b* and the secondary winding circuit boards 642*d*-642*f*) below the primary winding circuit boards 622*a*-622*c*. And the primary winding circuit boards 622*a*-622*c* are stacked between the secondary winding circuit boards (including the shielding winding circuit board 624*b* and the secondary winding circuit boards 642*d*-642*f*) at the top and the secondary winding circuit boards (including the shielding winding circuit board 624*a* and the secondary winding circuit boards 642*a*-642*c*) at the bottom.

In the embodiment, the secondary winding circuit boards at the top includes the secondary winding circuit board 642*d*-642*f* and the shielding winding circuit board 624*b*, winding traces 6242*b* on the shielding winding circuit board 624*b* are electrically connected to winding traces 6242*a* on the shielding winding circuit board 624*a*. Either the winding traces 6242*a* on the shielding winding circuit board 624*a* or the winding traces 6242*b* on the shielding winding circuit board 624*b* are electrically connected to the static node (e.g., the static node S shown in FIG. 3) and close to the primary winding circuit board 622*a* or 622*c*.

In one embodiment, winding traces 6422*a* on the secondary winding circuit board 642*a*-642*c* are electrically connected to winding traces 6242*a* on the shielding winding circuit board 624*a* and inductively coupled to the winding traces 6222 on the primary winding circuit boards 622*a*-622*c*. Winding traces 6422*b* on the secondary winding circuit boards 642*d*-642*f* are electrically connected to the winding traces 6242*b* on the shielding winding circuit board 624*b* and inductively coupled to the winding traces 6222 on the primary winding circuit boards 622*a*-622*c*.

In one embodiment, a static node connected to the winding traces 6242*a*, 6242*b* on the shielding winding circuit boards 624*a*, 624*b* can be one of the ground terminal and the output terminal, e.g., one terminal of the output capacitor Cout shown in FIG. 3. Thereby, the shielding winding circuit boards 624*a* 624*b* have the stable voltage and then provide shielding effect.

In another embodiment, the winding traces 6242*a*, 6242*b* on the shielding winding circuit boards 624*a* 624*b* have a wire diameter corresponding to the smallest metal width in the circuit board manufacturing process or to the largest metal width conforming the window size of the transformer 70. The wire diameter of the winding traces 6242*a*, 6242*b* may also be adjusted within the range from the smallest to the largest metal width according to the practical requirement. The winding traces on the shielding winding circuit boards are similar to winding traces of the shielding winding circuit boards 3246, 3248 shown in FIG. 4A-FIG. 4C, therefore detailed descriptions of winding traces are stated as above and no longer repeated here.

From the embodiment above, adopting the transformer in the embodiment of the present disclosure may achieve the effect of lowering the noise without an additional shielding layer such that the size of the transformer is smaller and the cost of the transformer is lower. The plane transformer in the present disclosure can be manufactured in mass production so as to lower the manufacturing cost.

Moreover, the transformer design without an additional shielding layer can make the distance between the primary winding unit and the secondary winding unit smaller, and can also decrease the leakage inductance of the transformer.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the present disclosure. In view of the foregoing, it is intended that the present disclosure cover modifications and variations of this disclosure provided they fall within the scope of the following claims.

What is claimed is:

1. A transformer, comprising:

a primary winding unit comprising:

a first input primary winding part;

a first shielding winding part, wherein the first input primary winding part is electrically connected to at least one switch component external to the primary winding unit, and the first input primary winding part is electrically connected to the first shielding winding part;

a second input primary winding part; and a second shielding winding part;

a secondary winding unit inductively coupled to the primary winding unit, wherein the first shielding winding part is disposed between the first input primary winding part and the secondary winding part; and a magnetic core, wherein the primary winding unit and the secondary winding unit are assembled to the magnetic core, wherein the second shielding winding part is disposed between the second input primary winding part and the secondary winding unit, and the first shielding winding part and the second shielding winding part are disposed on two opposite sides of the secondary winding unit, and the first input primary winding part, the second input primary winding part, the first shielding winding cart and the second shielding winding art are electrically connected.

2. The transformer as claimed in claim 1, wherein the first shielding winding part further comprises at least one shielding winding circuit board.

3. The transformer as claimed in claim 2, wherein winding traces on the shielding winding circuit board are electrically connected to a static node.

4. The transformer as claimed in claim 2, wherein winding traces on the shielding winding circuit board have a wire diameter corresponding to a smallest metal width in a circuit board manufacturing process or corresponding to a largest metal width which conforms to a window size of the transformer.

5. The transformer as claimed in claim 1, wherein the first shielding winding part is electrically connected to a static node.

6. The transformer as claimed in claim 1, wherein the first input primary winding part further comprises a plurality of primary winding circuit boards and the primary winding circuit boards are stacked with the first shielding winding part.

7. The transformer as claimed in claim 1, wherein the first shielding winding part and the second shielding winding part comprise at least one shielding winding circuit board respectively.

8. The transformer as claimed in claim 7, wherein winding traces on either the at least one shielding winding circuit board of the first shielding winding part or the at least one shielding winding circuit board of the second shielding winding part are electrically connected to a static node.

9. The transformer as claimed in claim 7, wherein the winding traces on the shielding winding circuit board have a wire diameter corresponding to a smallest metal width in a circuit board manufacturing process or corresponding to a largest metal width which conforms to a window size of the transformer.

10. The transformer as claimed in claim 1, wherein one of the first shielding winding part and the second shielding winding part is electrically connected to a static node.

11. The transformer as claimed in claim 1, wherein the first input primary winding part further comprises a plurality of first primary winding circuit boards, and the first primary winding circuit boards are stacked with the first shielding winding part; and the second input primary winding part further comprises a plurality of second primary winding circuit boards, and the second primary winding circuit boards are stacked with the second shielding winding part.

12. A transformer, comprising:

a plurality of first primary winding circuit boards that comprises a first shielding winding circuit board;

at least one secondary winding circuit board stacked with the first primary winding circuit boards, further comprising:

a second shielding winding circuit board, winding traces on the second shielding winding circuit board are electrically connected to winding traces on the first shielding winding circuit board and close to the at least one secondary winding circuit board; and winding traces on either the first shielding winding circuit board or the second shielding circuit board are electrically connected to the static node, wherein winding traces on the first shielding winding circuit board are close to at least one secondary winding circuit board;

a plurality of second primary winding circuit boards stacked in relative to the first primary winding circuit boards, wherein the at least one secondary winding circuit board is stacked between the first primary winding circuit boards and the second primary winding circuit boards, wherein winding traces on the second primary winding circuit boards are electrically connected to the winding traces on the second shielding winding circuit board and inductively coupled to winding traces on the at least one secondary winding circuit board; and a magnetic core, wherein the first primary winding circuit boards and the at least one secondary winding circuit board are assembled to the magnetic core.

13. The transformer as claimed in claim 12, wherein winding traces on one of the first primary winding circuit boards, which is the furthest away from the at least one secondary winding circuit board, are electrically connected to at least one switch component.

14. The transformer as claimed in claim 12, wherein winding traces on the first shielding winding circuit board have a wire diameter corresponding to a smallest metal width in a circuit board manufacturing process or corresponding to a largest metal width which conforms to a window size of the transformer.

15. The transformer as claimed in claim 12, wherein the static node is one of a ground terminal and a direct-current bus.

16. The transformer as claimed in claim 12, wherein winding traces on the first primary winding circuit boards are electrically connected to winding traces on the first shielding winding circuit board and inductively coupled to winding traces on the at least one secondary winding circuit board.

17. The transformer as claimed in claim 12, wherein the winding traces on the first shielding winding circuit board and the second shielding winding circuit board have a wire diameter corresponding to a smallest metal width in a circuit board manufacturing process or corresponding to a largest metal width which conforms to a window size of the transformer.

18. The transformer as claimed in claim 12, wherein the static node is one of a ground terminal and a direct-current bus.

* * * * *